United States Patent [19]

Reiter

[11] 3,956,606

[45] May 11, 1976

[54] CABLE OPERATED SAFETY STOP SWITCH

[75] Inventor: Robert C. Reiter, Aurora, Ill.

[73] Assignee: Material Control, Inc., Aurora, Ill.

[22] Filed: Apr. 25, 1974

[21] Appl. No.: 463,883

[52] U.S. Cl. ..... 200/161

[51] Int. Cl.[2] ..... H01H 17/08

[58] Field of Search ..... 200/153 F, 161, 153 LB, 200/323, 324, 325, 61.8, 331, 332, 291, 327, 47; 74/483 R, 483 K; 192/129

[56] References Cited

UNITED STATES PATENTS

| | | | |
|---|---|---|---|
| 730,573 | 6/1903 | Sargent | 200/323 X |
| 1,471,210 | 10/1923 | Rosen | 200/161 |
| 1,614,511 | 1/1927 | Wicks | 200/161 X |
| 1,693,608 | 12/1928 | Lippert | 200/161 X |
| 1,696,902 | 1/1929 | Clerico | 200/161 |
| 1,783,656 | 12/1930 | Krastin | 200/161 |
| 2,030,671 | 2/1936 | Williams | 200/327 |
| 2,364,995 | 12/1944 | Mueller | 200/161 X |
| 2,477,589 | 8/1949 | DuShane | 74/483 |
| 3,440,582 | 4/1969 | Gerspach | 335/138 |

FOREIGN PATENTS OR APPLICATIONS

| | | | |
|---|---|---|---|
| 1,060,152 | 3/1967 | United Kingdom | 200/153 F |
| 317,613 | 8/1929 | United Kingdom | 200/331 |

*Primary Examiner*—Herman J. Hohauser
*Attorney, Agent, or Firm*—Cullen, Settle, Slomen & Cantor

[57] ABSTRACT

The switch unit, suitable for use in instances of emergency and also for a normal electrical shut-off and resetting of a controlled system, features a snap-action electrical switch, as an example, a microswitch type control operated selectively (or jointly) by a pair of like end-anchored tension cables which have their inner ends connected to the unit's operating and re-set signal arm to trip the latter from a normal release position upon a tensioning of either cable by an attendant. The tripping of the arm causes it to operate the snap-action switch, and the arm is automatically locked in the tripped position thereof, having with said switch typically interrupted the electrical operation of the controlled system. That is, a tensioning of either one of the cables under a force exceeding a very moderate value occasions a limited rotation of a shaft carrying the arm; this suffices to actuate the snap-action switch, and thereby through conventional wiring means to initiate an instantaneous cut-off of the system's electrical supply. The shaft and arm are automatically locked in their tripped condition by a locking plate fixed on and rotatable with the shaft, which plate presents locking pins adapted to engage and latch in a fixed keeper plate of the switch unit. The locking plate is axially movable with the shaft in opposition to relatively mild spring bias to disengage the locking pins from the keeper plate, thereby releasing the shaft for manual counterrotation from locked condition to normal release condition.

21 Claims, 6 Drawing Figures

CABLE OPERATED SAFETY STOP SWITCH

BACKGROUND OF THE INVENTION

1. Field of the Invention

The improved safety stop switch has application in many specifically different fields in which there is a need for a positive and rapid shutdown of governed equipment. Typical such applications are in belt or related types of material conveyors, production lines, elevator equipment, other material handling systems, cranes, assembly lines, mines, quarries and the like.

2. Description of the Prior Art

Various producers market safety stop switches of the general rope or cable-operated type of the present improvement. However, all are to my knowledge subject to serious drawbacks of one sort or another. For example, in some instances the switch, after being tripped to presumably cut off a supply of electrical power to an operating system of the sort mentioned in the Field, can be just as readily be re-set accidentally (and often disastrously) to restore said system to a powered condition, as by an inadvertent application of force to the rope or cable or the latter's operating arm.

In other instances, competing controls comparable in effectiveness to that of the present improvement require duplication of parts, multiple limit or microswitch units, etc., with the further complications of installation and maintenance wiring attendant thereto. While the present unit envisions a resort of two switches to afford separate audible or visual alarm signals, the basic switch unit of the invention needs only one snap-action switch which may be normally open or normally closed as hooked up with simple conventional wiring.

SUMMARY OF THE INVENTION

In other respects, the switch unit of the invention has its operating parts tightly sealed, in particular for outside operations, within a two-part housing structure which is readily and quickly opened for access to its interior, and presents ample interior space for ease and convenience in manipulations of installation, maintenance or servicing.

The switch unit offers a true safety lock or fail-safe feature, once tripped, in that in restoring or re-setting it to its original release condition two steps must be performed by the attendant or operator. He must first free the signal flag arm by shifting it and its shaft axially against a mild spring bias to disengage certain locking pins fixedly connected thereto from a fixed internal keeper plate; and he must then counter-rotate the shaft sufficiently to restore it in the release position.

Both the locked and release positions are resiliently and releasably maintained by a suggested spring and detent cam unit, the cam of which is fixed on said shaft; and the unit allows the latter to rotatively yield under cable-applied torque, the value of which is adjustable by altering either, or both, the moment arm connection of the cable to the signal arm (as represented by any one of several available cable couplings to said arm at different distances from its rotational axis), or by an adjustment of the force exerted by the detent unit. There are two independently tensionable cable connections, extending from the operation and re-set arm to fixed anchors at opposite ends of the equipment's framework, which represents greater convenience and potential speed of operation by the attendant, as well as the ability of both cables to be simultaneously torsioned and thus multiply the force exerted upon said operating arm.

DESCRIPTION OF A PREFERRED EMBODIMENT

Figure 1:
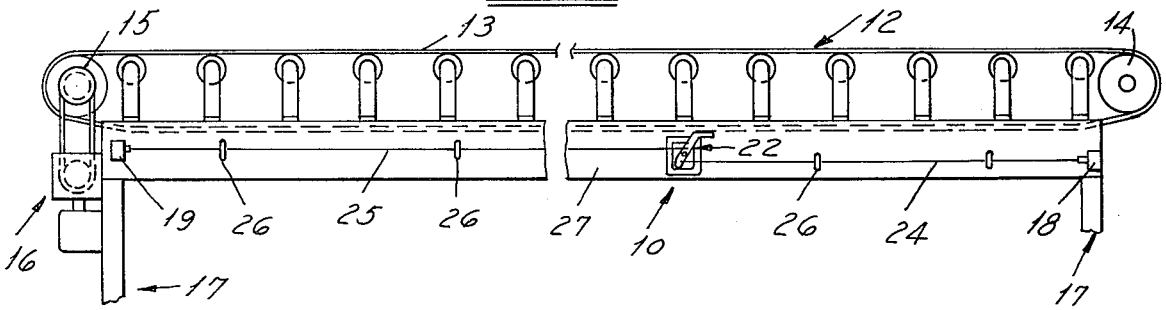
FIG. 1 is an elevational view very schematically illustrating a cable-operated safety stop switch pursuant to the invention in one of many possible applications thereof, typically in an electric motor-driven endless belt-type conveyor system, with cable components of the switch operatively connected between a signaling flag and re-set arm of the switch and a pair of fixed end anchors for the cables.

FIG. 1 schematically shows a safety switch pursuant to the invention, as generally designated by the reference numeral 10, in a typical above-instanced installation for the stop control of a conventional endless belt-type conveyor 12. This comprises a horizontally disposed, multiple roller sustained upper belt reach 13 trained about opposite end pulleys 14 and 15, the latter of which is powered by a motor, speed-reducer and chain driving combination or set, generally designated 16. Typically, this drive will be controlled through appropriate wiring and conventional switch means (neither shown) over and above the microswitch means of unit 10. A rigid framework 17 sustains the conveyor assembly 12, this frame structure affording fixed cable loop anchors 18 and 19 adjacent its opposite ends. As indicated above in the Field, the switch of the invention is applicable for the automatic stop or related type control of many other types of mechanism indeed; the conveyor or installation of FIG. 1 furnishes a simple and convenient background against which various advantages of the unit 10 may be set.

Figure 2:
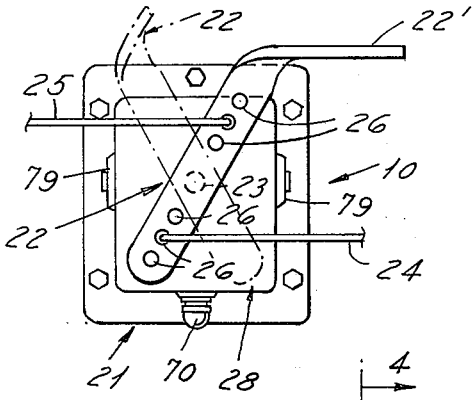
FIG. 2 is a fragmentary front elevational view of the switch unit per se in somewhat larger scale, showing its rotatably actuated flag and re-set arm in solid line in a normal released position, yet ready to signal instantaneously both visibly and electrically, upon an attendant's cable actuation of the switch, thus to de-energize the switch controlled system, the position of said arm as thus cable-operated being shown in dot-dash line.

Referring to FIG. 2 in conjunction with FIG. 1, said safety stop switch generally comprises a by-partite housing, generally designated 21, whose features will later be detailed further; and an actuating or operating signal and re-set arm 22 presenting a distinctive flag tail 22′ is rigidly mounted upon an external end of a longitudinally extending shaft or spindle 23 which is appropriately journaled by housing 21. Flexible cables, ropes or like tension members 24 and 25 connect from the respective anchor loops 18 and 19 to the flag and re-set arm 22; and in the interest of adapting switch unit 10 to varying load limits or other requirements of the installation, these cables are each selectively connected at the inner end thereof to one of several holes 26 of two sets formed at either side of the arm's shaft 23, being depicted in FIG. 2 as two sets of three equally spaced holes each. In order to offset the effect of their weight, said cables 24, 25 are shown in FIG. 1 as being sustained at longitudinal intervals by appropriately spaced looplike guide elements 26 fixed to a horizontal beam length 27 of the frame 17.

Figure 3:
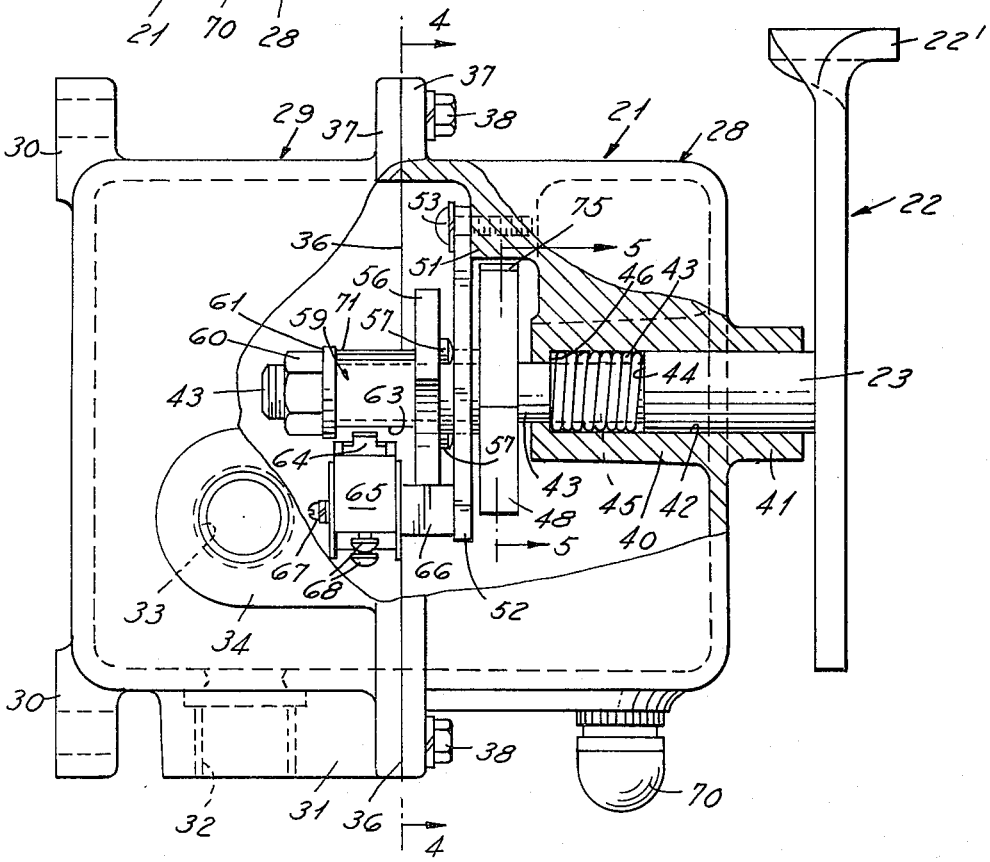
FIG. 3 is a still further enlarged view in elevation, partially broken away and sectioned in a vertical plane including the transverse axis of operation of a shaft or spindle bearing said arm.

As best shown in FIG. 3, the switch housing 21 is comprised of two generally similar, hollow rectangular box-like halves 28, 29 of cast aluminum, the latter of which bears integral external attachment lugs or ears 30, at which the housing may be appropriately bolted rigidly to the conveyor frame length 27 in a typical intermediate position appearing in FIG. 1. The housing half 29 is shown (FIG. 3) as being formed with an enlarged bottom boss 31 having an externally opening pipe tap 32 to receive standard electrical conduitry (not shown). Similar taps 33 may optionally be provided in integral housing bosses 34 at opposite sides of the housing member 29.

This housing component engages at an upright interface 36 with the other housing half 28, the interface or juncture being at laterally outwardly extending integral flanges 37 of the halves 28 and 29. Here the two said aluminum housing parts are releasably secured together by bolt and lock washer means 38. There is thus provided an arrangement by which the housing halves parts are tightly sealed against the weather, but may be quickly and easily separated, with ample space therein for access to internal components to be described, and just as easily re-assembled with a minimum of "down" time.

Figure 6:
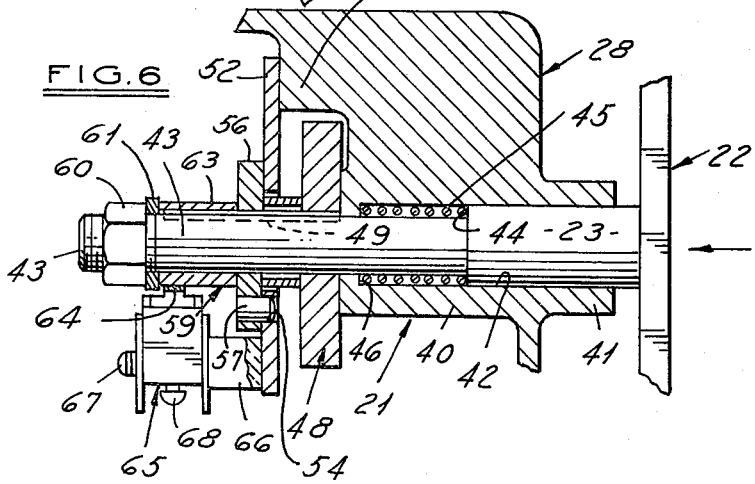
FIG. 6 is a further fragmentary view in vertical longitudinal section on a line corresponding to line 6—6 of FIG. 4, in this case showing detent cam, locking plate and microswitch components of the unit in their locked position, after being tripped from the FIG. 3 release position and prior to being manually reset in said position.

Referring to FIGS. 3 and 6, the housing half 28 is provided with an enlarged integral boss 40 extending across one inner side thereof, with an external continuation 41 of said boss projecting outwardly of the housing. This boss structure rotatively journals the stem or shaft 23 of signal flag and re-set arm 22 in a horizontal boss bore 42; and said shaft has a reduced portion 43 to the left of a shaft shoulder 44. The shaft reduction 43 projects to the left (FIGS. 3 and 6) through a reduced diameter bore at the inner end of boss 40; and a coil compression spring 45 acts between the shaft shoulder 44 and an axially inwardly spaced reaction surface 46 to the left of the full diameter of boss bore 42. FIG. 3 shows spring 45 as being tightly compressed in a normal relaxed condition of switch unit 10, with effects to be described; while FIG. 6 shows said spring in an expanded condition, in which the switch shaft 23 has been temporarily locked against rotation, its arm 22 having been tripped by a manual tensioning of a cable 24 or 25.

Figure 5:
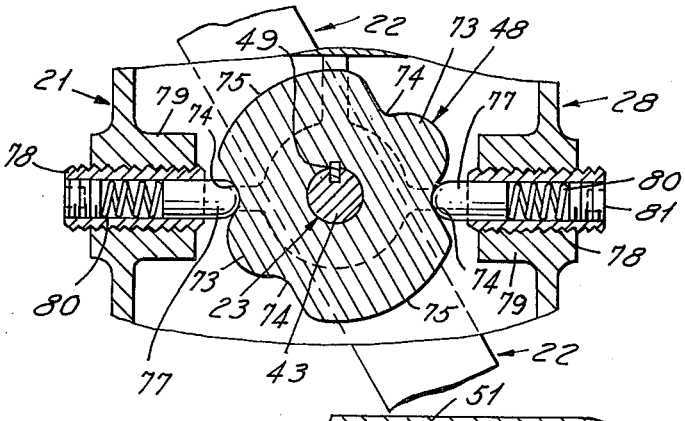
FIG. 5 is a fragmentary view in transverse vertical section on line 5—5 of FIG. 4, showing details of a proposed detent cam and holding spring arrangement of the switch.

A specially shaped detent cam 48 of hardened steel is fixed on the reduced diameter shaft portion 43 directly to the left of the internal housing boss 40, as through the agency of key means 49 appearing in FIGS. 5 and 6; and as shown in FIG. 6 the cam bears to the right on the inner upright surface of said boss in the cable-tripped and locked condition of switch 10. However, as an initial incident to the re-setting of the switch to its release position, the manual exertion of predetermined axial force on shaft 23, at its arm 22 and against the force of coil spring 45, results in the detent cam 48 being bodily shifted to the left along with said shaft to the position shown in FIG. 3, placing said cam in axially spaced relation to the boss 40 and conditioning unit 10 for the second-step completion of the re-set operation.

Figure 4:
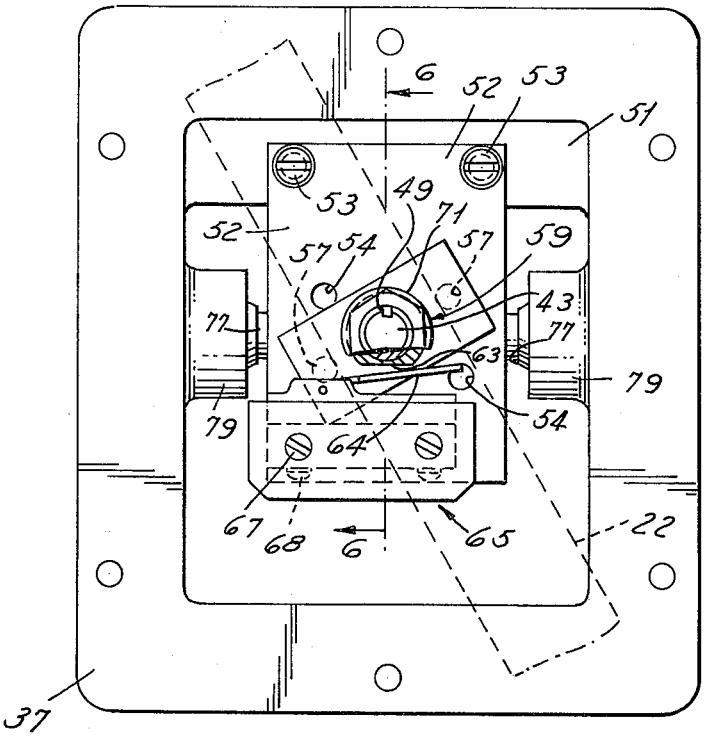
FIG. 4 is a view of the unit with a cast housing half thereof removed, being in the vertical plane of the line 4—4 of FIG. 3, and also being partially broken away to show the switch unit in a normal release position thereof.

As appears in FIGS. 3, 4 and 6, an inner integral cross-boss extension formation 51 carries a fixed keeper plate 52, being rigidly secured thereto by a pair of screws 53 threadedly taking into said formation; and this plate is provided on diametrically opposite sides of the axis of the shaft 23 (which passes through a central plate opening) with a pair of keeper holes 54 (FIGS. 4 and 6). For coaction with said keeper holes in rigidly holding the shaft in its locking position of FIG. 6, the reduced diameter shaft portion 43 fixedly carries, as at the key connection 49, a rectangular locking plate 56; this is equipped, at points also diametrical of the shaft axis, with a pair of locking studs or pins 57, which fixedly project therefrom in the direction toward keeper plate 52. With the shaft 23 and plate 56 continually biased to the right under the force of coil spring 45, and with said spring compressed to its condition of FIG. 3, a rotative approximately 60° movement of flag arm 22 will cause the plate's locking pins 57 to become aligned with and seat into the correspondingly spaced holes 54 of keeper plate 52 when axial spring compression has terminated. As shown in FIG. 6, there is thus a positive lock of the shaft end 23 in the tripped signaling position of the arm 22. Assuming that an occasion, emergency or otherwise, which prompted an attendant to pull a trip cable 24 or 25 no longer exists, it is necessary for him to re-perform the two re-set operations, i.e., first depress arm 22 and shaft 23 to the left as indicated by arrow in FIG. 6, and then counter-rotate arm 22 to the normal released position thereof shown in FIGS. 1, 2 and 3. Said arm, shaft and parts rotatable therewith in the trip and re-set phases are releasably and resilently restrained angularly by means later described.

Included in said parts is a microswitch-operating cam sleeve 59 keyed at 49 to and adjacent the left-hand end of the reduced diameter shaft portion 43, and bearing directly against the locking plate 56. Said sleeve member 59 is axially held fixedly in assembly with locking plate 56 and detent cam 48 by a nut 60 threaded on the end of shaft portion 43, with a spring lock washer 61 interposed.

As appears best in FIG. 4 and in conjunction with FIGS. 3 and 6, the sleeve 59 has a flatted segmental side surface 63; and in the normal released condition of the switch unit 10 said flat 63 is in laterally upwardly spaced relation to the actuating arm 64 of a normally open limit switch 65. Typically, this is a conventional single pole, double throw microswitch rated for 20 amperes at 125, 250 or 480 volts AC. It may of course be wired for single throw operation; and a normally closed-type may be employed with appropriate obvious change in the wiring.

The snap-action electrical switch 65, as an example, a microswitch type control is fixedly mounted on a spacer bar 66 (FIGS. 3 and 6) welded to an adjacent surface of the keeper plate 52, as through the agency of a pair of screws 67, and switch 65 presents at its bottom a set of three electrical terminal posts 67 and 68. Electrical leads (not shown) will be connected to a center post 68 of the set, enabling an electrical switch signal circuit to be completed through it and one of the other terminals 67; while the second terminal 67 may optionally be wired through a conventional low voltage signaling lamp 70 or an audible alarm device.

Energization of these circuits occurs when the remaining quasi-cylindrical, unflatted surface 71 of the sleeve 59 is rotated more than a very few degrees upon a tensioning of a cable 24 or 25, thus to swing the signal flag and re-set arm 22 to an operated position from its normally released position. The same released position of arm 22 is depicted in FIGS. 4 and 5, in which position said arm and the shaft 23 are releasably held until a predetermined torque is cable-applied to switch unit 10; and this also holds true when the shaft has been rotated to its locked condition. Provision to this end involves the spring-detented cam arrangement best shown in FIG. 5, or an equivalent arrangement.

That figure depicts the detent cam 48 as being in a cross-section to provide a pair of diametrically opposite, like convexly arcuate nodes 73, each located between a pair of concave seat formations 74. Said seat pairs are separated by circumferentially and diametrically enlarged stop formations 75 which do not come into significant play in the operation of the switch 10.

A pair of like cylindrical and round-nosed detent pins 77 bear in directions toward one another against the above-described cam-shaped outer surface of member 48, the pins normally resting, in both the release and tripped conditions of switch 10 (FIG. 5), in a diametrically opposed pair of the seats 74. Pins 77 are each mounted for limited sliding action in an externally threaded sleeve element or nipple 78, which takes into an integral, internally threaded side boss 79 in the half 21 of cast aluminum housing 28. Coil compression springs 80 act between the respective detent pins 77 and stop plugs 81 threaded into the nipple elements 78, thus to hold said pins in an adjustably set position and thereby adjustably set the torque force against which the pins 77 yield radially and permit rotation of shaft 23. This force may range from 20 lbs. to 40 lbs.

It is evident that the cam and detent type of releasable arm-holding unit shown in FIG. 5 may well be replaced by equivalent resilient detenting arrangments, for example a pair of oppositely acting tension spring sets biasing crank or like elements on opposite sides of the rotative axis of signal arm 22. But in any such equivalent arrangement a choice of cable connections to said arm at the sets of holes 26 will afford a very desirable option as to the torquing moment applied through the cable 24 and/or 25.

The single snap-action switch 65 serves in controlling a power cut-off of the governed system 12 under cable pulls in two opposite directions; and while the above description bears in the main on the ordinarily desired shutting off of electrical energization of such a governed system, it is of course evident that the function of switch 10 may also be directed to a system's mode other than power cut-off, and that the system may be powered otherwise than electrically.

What is claimed is:

1. A switch unit to control at least in part the operation of a powered system, comprising a shaft rotatively mounted to pivot between operated and release positions and axially shiftable as an incident to its pivoting between said positions, operating arm means connected to said shaft to selectively so pivot the same, at least one externally actuated cable operatively connected to said arm means to actuate the latter in pivoting the shaft, and means releasably locking said shaft at one of said operated and release positions while permitting a rotative pivoting of the shaft from said one position to said other position, said last named means comprising a locking member rotatable and axially shiftable with said shaft, and a fixed keeper member engageable with said locking member in one of its said pivoted positions to so lock the latter in that position, said locking and keeper members being disengaged upon an axial shift of said shaft to free the latter to pivot to its said other position.

2. The switch unit of claim 1, in which said shaft is rigidly but releasably held by said locking and keeper members at said operated position, and further comprising means for yieldably maintaining said shaft at the release position subject to pivoting of the shaft through its cable-connected arm means toward said operated position.

3. The switch unit of claim 1, and further comprising a switch device closed and opened by means on said shaft upon the latter's pivoting between said positions, said switch device being connectable to said system to at least in part control the powering thereof.

4. The switch unit of claim 2, and further comprising a switch device closed and opened by means on said shaft upon the latter's pivoting between said positions, said switch device being connectable to said system to at least in part control the powering thereof.

5. The switch unit of claim 1, in which there are at least two of said externally operated cables, each of said externally operated cables having at least one end which is connected to said operating arm means of the switch unit.

6. The switch unit of claim 2, in which there are at least two of said externally operated cables each anchored at one end and having its opposite end connected to different portions of said operating arm means of the switch unit.

7. The switch unit of claim 6, in which the connections of said cables to said arm means are at selective different distances from the axis of rotation thereof and of said shaft, thereby affording optional torque moment arms for application of force from said cables to the shaft depending upon the selected distance at which said cables are attached to said arm means.

8. A resetable safety lock switch unit comprising:

a shaft mounted for rotational movement between a released switch position and a tripped switch position;

a switch-operating arm connected to said shaft for rotating the same between said released switch position and said tripped switch position;

detent means for resiliently and resistively biassing said shaft against rotation until at least a predetermined amount of force is applied to said switch-operating arm and responsive to the application of at least said predetermined amount of force to said switch-operating arm for allowing said shaft to rotate from one of said switch positions to the other; and latching means responsive to said detent means having allowed said shaft to be rotated from the released switch position to the tripped switch position for axially moving said shaft and locking the same against further rotation, said latching means being further responsive to axial pressure applied to said shaft for unlocking said shaft and allowing reverse rotation against said detent means to restore said shaft to the released switch position when at least said predetermined amount of force is applied to said switch-operating arm.

9. The resetable safety lock switch unit of claim 8 wherein said switch unit is useable to control at least in part the operation of a powered system, said switch unit further comprising;

an electrical switching element coupled to said powered system to at least in part control the powering thereof;

and means at least partially coupled to said shaft and positionable thereby for maintaining said electrical switching element in a first electrical state to permit the powering of said system when said shaft is in said released switch position and responsive to said shaft having been rotated to said tripped switch position for switching said electrical switching element to the opposite electrical state to terminate the powering of said system.

10. The resetable safety lock switch unit of claim 8 and further comprising externally-activated means operatively coupled to said switch-operating arm for applying force thereto and actuating said switch-operating arm to rotate said shaft when applied force equals or exceeds said predetermined amount.

11. The resetable safety lock switch unit of claim 10 wherein said switch-operating arm includes a central arm portion for rigidly connecting said switch-operating arm to said shaft, a first arm portion extending in a first radial direction away from said shaft, and a second arm portion extending in the opposite radial direction away from said shaft, and wherein said externally-activated means includes a first cable-like element fastenable to said first arm portion for applying force in a direction for establishing a torque moment to rotate said shaft means toward said tripped switch position and a second cable-like element fastenable to said second arm portion for applying force in the opposite direction establishing a similar torque moment to rotate said shaft means towards said tripped switch position.

12. The resetable safety lock unit of claim 10 wherein said switch-operating arm includes a plurality of connection-enabling means spaced at different distances from the axis of rotation of said switch-operating arm for selectively connecting said externally-activated means for affording different torque moment arms for applying force to said shaft.

13. The resetable safety lock switch unit of claim 8 wherein said switch-operating arm includes a flag indicator which is readily visible when said switch is in said tripped switch position and which is substantially less visible when said switch is in said released switch position.

14. The resetable safety lock switch unit of claim 8 wherein said switch unit further includes a sealable easy-access corrosion-resistant housing means for housing said shaft means, said detent means and said latching means.

15. The resetable safety lock switch unit of claim 8 wherein said detent means comprises:

cam means including a pair of concave cam seats and a convexly arcuate cam node located between said pair of cam seats;

means for connecting said cam means to said shaft for rotation therewith; and detent means including a detent member for contacting said cam means and detent biassing means for resiliently urging said detent member into contact with said cam means, said detent member normally contacting one of said pair of cam seats when said switch is in either of said released switch position or said triggered switch position and being urged against said cam node to resist the rotation of said shaft until at least said predetermined amount of force has been applied to said switch-operating arm, at which point said cam node rides over said detent member to position said switch to the other of said released switch position or said triggered switch position and to enable said detent member to contact the other of said pair of cam seats.

16. The resetable safety lock switch unit of claim 8 wherein said latching means comprises:

boss means for rotatively journaling said shaft means;

locking means rigidly attached to said shaft for movement therewith;

a keeper plate rigidly attached to said boss means and adapted for engaging said locking means to lock said shaft against rotation when said switch has been moved to said triggered switch position; and resilient biassing means for normally urging said shaft and said locking means in a first axial direction toward said keeper plate and responsive to said shaft having been rotated to said triggered switch position for axially moving said shaft and said locking means in said first axial direction with respect to said keeper plate for enabling said locking means to lockably engage said keeper plate, said locking means remaining lockably engaged with said keeper plate to prevent rotation of said shaft until said shaft is manually moved in a second and opposite axial direction to move said locking means away from said keeper plate to disengage the same and allow said shaft to be rotated upon the application of at least said predetermined amount of force to restore said switch to said released switch position.

17. A safety stop switch assembly for the positive and rapid shut-down of powered equipment comprising:

a rotatably and axially movable shaft mounted for rotational movement between a normal switch position and a triggered switch position;

a switch-acuating arm connected to said shaft for rotation therewith, said arm being adapted for receiving externally applied force and applying a moment arm to rotate said shaft in a first direction whenever a minimum predetermined amount of external force is applied; and failsafe locking means responsive to said shaft having been rotated to said triggered switch position for axially moving said shaft and locking the same against further rotation to avoid the possibility of said switch accidentally being restored to said normal switch position, said locking means being further responsive to externally applied positive axial force to unlock said shaft so that rotational force applied in the direction opposite said first direction will rotate said shaft and restore said switch to said normal switch position.

18. The safety stop switch assembly of claim 17 further comprising an electric switch having a first electrical state of normally allowing power to be supplied to said powered equipment and the second state for terminating the supply of power to said powered equipment and switch control means associated with said shaft for normally maintaining said electrical switch in said first electrical state and responsive to said shaft having been rotated to said triggered switch position for immediately triggering said electrical switch to said second electrical state.

19. The safety stop switch assembly of claim 17 further includes an external force-applying means connectable to said arm for imparting a moment arm to said shaft and wherein said arm includes a plurality of cable-fastening portions spaced at different distances along said arm radially away from the axis of rotation of said shaft, said external force-applying means including a cable-like member connectable to a selected one of said plurality of cable-fastening portions for applying moment arms to said shaft.

20. The saftey stop switch assembly of claim 19 wherein said arm further includes a second extension having a plurality of cable-fastening portions spaced at different distances along said arm radially away from the axis of rotation of said shaft and in the opposite direction to the portion of said arm having said first plurality of cable-fastening portions thereon, and wherein said external force-applying means includes a first cable selectively connectable to one of said first plurality of cable-fastening portions for providing a moment arm in a desired direction when said first cable is pulled in a first direction and a second cable selectively connectable to one of said second plurality of cable-fastening portions to provide a moment arm in said desired direction when said second cable is pulled in a direction opposite that of said first cable thereby enabling said external force-applying means to be operated by either one or both of two cables extending in in opposite directions from said arm.

21. The safety stop switch assembly of claim 17 further comprising a snap-action rotational biassing means for resisting the rotation of said shaft until at least said minimum predetermined amojnt of external force is applied and for then overcoming the rotational resistance and allowing said shaft to rotate to the opposite switch position thereafter, said locking means not being enabled to actually move and lock said shaft until after said snap action rotatable biassing means has been overcome and said switch moved from said normal switch position to said triggered switch position and said snap action rotational biassing means being disabled for returning said shaft from said triggered switch position to said normal switch position until after said locking means has been unlocked by the application of externally applied positive axial force thereby assuring that the switch can not be accidentally restored to the normal switch position.

* * * * *